United States Patent [19]

Hudson

[11] Patent Number: 4,473,044

[45] Date of Patent: Sep. 25, 1984

[54] MILEAGE IMPROVEMENT SYSTEM FOR INTERNAL COMBUSTION ENGINES

[76] Inventor: Kenneth Hudson, 477 N. Fern St., Orange, Calif. 92667

[21] Appl. No.: 569,044

[22] Filed: Jan. 9, 1984

[51] Int. Cl.[3] ..... F02D 17/02

[52] U.S. Cl. ..... 123/198 F; 123/DIG. 7

[58] Field of Search ..... 123/198 F, 198 DB, DIG. 1, 123/DIG. 6, DIG. 7; 60/712, 716, 719, 720

[56] References Cited

U.S. PATENT DOCUMENTS

| | | | |
|---|---|---|---|
| 1,138,077 | 5/1915 | Buchi | 123/198 F |
| 3,744,934 | 7/1973 | Ueno | 123/198 F |
| 3,941,113 | 3/1976 | Baguelin | 123/198 F |
| 3,945,367 | 3/1976 | Turner, Jr. | 123/198 F |
| 4,018,204 | 4/1977 | Rand, Jr. | 123/198 F |
| 4,070,971 | 1/1978 | Studebaker | 123/198 F |
| 4,075,837 | 2/1978 | Hanaoka | 123/198 F |
| 4,105,010 | 8/1978 | Rand, Jr. | 123/198 F |
| 4,124,012 | 11/1978 | Fuller, Jr. | 123/198 F |
| 4,207,855 | 6/1980 | Phillips | 123/198 F |
| 4,250,850 | 2/1981 | Ruyer | 123/198 F |

*Primary Examiner*—Ira S. Lazarus

*Attorney, Agent, or Firm*—Gilbert A. Thomas

[57] ABSTRACT

A mileage improvement system for internal combustion engines that is formed by having four minimum cylinders equipped with a separate manifold and able to handle the minimum power requirements of the vehicle plus 10%. Coupled to them are four unloading cylinders larger in size and each containing an unloading valve emptying into an unvented unloading manifold.

An unloading valve located in the separate unloading cylinders manifold and sensitive to the vacuum in the minimum cylinder manifold. The control valve, like a solenoid or other mechanical device, located in the unloading cylinders manifold controls a blade that shuts off the manifold's contents to the large unloading cylinders.

3 Claims, 5 Drawing Figures

MILEAGE IMPROVEMENT SYSTEM FOR INTERNAL COMBUSTION ENGINES

BACKGROUND OF THE INVENTION

1. Field of the Invention

This invention relates generally to methods and apparatus for improving the mileage of internal combustion engines and more particularly to methods and apparatus for converting an 8 unlike cylinder engine to a 4 like cylinder engine on demand for less power thereby reducing the fuel requirements of the engine.

2. Description of the Prior Art

In compliance with the requirements and guidance of 37CFR 1, 56, 1.97 and 1.9 and with section 609 of the Manual of Patent Examining Procedures the following statement is provided:

U.S. Pat. No. 4,018,204 to Rand show a device with claimed fuel saving capabilities. The apparatus described by Rand is contained on one or more of a multiple-cylindered internal combustion engine. A remotely and independently controlled fuel saving valve is operatively positioned to provide selective communication between the cylinder clearance volume and a filtered air portion of the engine carburetor. The valve is closed for normal, full power engine operation. It is open for predetermined low engine power demand periods. The opening of said valve severly reduces cylinder intake vacuum and resultant airfuel influx as to render temporarily ineffective the cylinder selected, thereby reducing engine fuel consumption.

The fuel saving valve of Rand connects to the carburetor and the reservoir. One fuel saving valve is needed for each cylinder. A surge tank is often used as a reservoir. Thus the Rand device needs several additional pieces of apparatus to operate and makes no mention of the additional smog problems that arise.

U.S. Pat. No. 4,207,855 to Wayne Phillips shows a device for claimed fuel conservation. It provides for these claims a number of active cylinders in a multi-cylindered internal combustion engine which vary in response to the operating requirements of the engine. Certain cylinders are rendered inactive by de-energizing the spark and concurrently activating a solenoid valve which causes the fuel mixture in those cylinders which are de-energized, may be bypassed through the cylinders and returned to the fuel supply for later use. While eliminating by-product increase Phillip's fuel conservation system adds new spark means, a spark suppressor means, and tubes from every cylinder to the carburetor.

Other claimed fuel saving apparatus is illustrated in Rand, U.S. Pat. No. 4,018,204; Studebaker, U.S. Pat. No. 4,070,971; Fuller, U.S. Pat. No. 3,124,012 and Ruyer U.S. Pat. No. 4,250,850, which were revealed in the search. All require either dismembering the engine, reducing the air-fuel influx so as to increase engine waste products or the use of, in a four cylinder engine, less than four cylinders and provision for an additional expansion enclosure for the gases issuing from the combustion cylinders before release into the atmosphere. None of the apparatus of the prior art include a system that involves 8 cylinders, only 4 of which are permanently used. An unloading valve adds the other 4 cylinders as power requirements demand.

The unloaded and loaded cylinders work in sets each supplying a portion of total power requirements in exactly the same stroke and firing sequence. This prevents any balance problems from effecting operations during the unloading sequence.

SUMMARY OF THE INVENTION

A mileage improvement system is provided which provides eight workable cylinders of which only four are constantly working giving the power of a large displacement engine but the economy of a small displacement engine. A fuel saving valve respondent to power demands of the vehicle is the key unit to the invention.

It is therefore a general object of this invention to provide a mileage improvement system of a small displacement engine vehicle yet still obtain the power performance of a large displacement engine vehicle.

Another object of this invention is to control combustion in the larger cylinders in response to engine torque requuirements by unloading the cylinder compression.

A still further object of this invention is to provide an unloaded valve that is responsive to engine torque requirements that controls the output of the four large cylinders.

Yet another object of this invention is to operate the paired large and small pistons in identical action so as to eliminate balance problems.

Another and further objects, features and advantages of the present invention will be readily apparent to those skilled in the art upon a reading of the description of the preferred embodiment which follows when read with reference to the accompanying drawings.

DESCRIPTION OF THE PREFERRED EMBODIMENT

Figure 1:
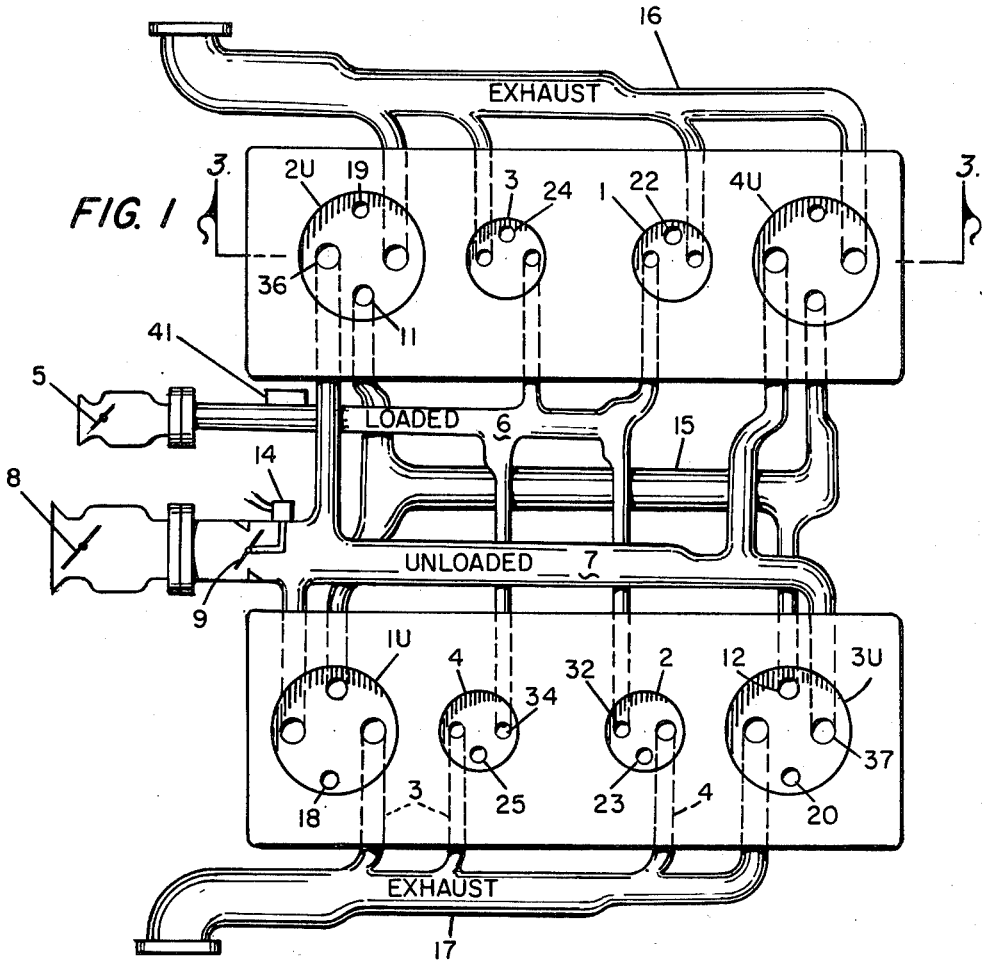
FIG. 1 is a schematic view of the underside portion of an internal combustion engine head showing the inlet and exhaust tubes and the various size cylinders of this invention.

A system for the mileage improvement of internal combustion engines is provided that provides the means to achieve large displacement power with small displacement economy. The engine may be a V-8 as illustrated or an in-line 8 (not illustrated). Four cylinders 1,2,3,4 are sized to produce horsepower equal to the minimum requirements of the particular vehicle plus 10%. These four cylinders have an independent carburator system and independent fuel loading manifold 6 to provide a fuel-air mixture to cylinders 1,2,3 and 4. Four unloading cylinders 1U,2U,3U and 4U each greater in diameter than 1,2,3, and 4 and designed to be of a size to provide horsepower equal in output to the maximum required by the vehicle when coupled with cylinders 1,2,3, and 4. That is output of cylinders 1,2,3 and 4 when added to the output of 1U, 2U, 3U and 4U will equal the maximum output required by the vehicle.

A separate manifold system 7 is used to provide fuel for 1U, 2U, 3U and 4U. It contains a separate carburator 8 and a unique unloading manifold valve 9 as well as unloading valves 10, 11, 12 and 13 in each cylinder. When the car starts and begins to accelerate the valve 9 is open, valves 10, 11, 12 and 13 are closed and all eight cylinders operate to produce the maximum power output for the vehicle. As the vehicle either maintains a cruising speed, idles, travels downhill or is in any other mode which requires less power the valve 9 is closed by the vacuum switch 41 in the loaded intake manifold 6 activating a solinoid or other mechanical device 14. Unloader valves 10, 11, 12, 13 open also activated by the same impulse from the manifold vacuum switch 41 acting through a solenoid or other mechanical device (not shown). The engine output is lowered since cylinders 1U, 2U, 3U and 4U receive no fuel and also releases the pressure and volume from the cylinders into chamber 15 where it will be displaced into unloaded cylinders with opposite stroke as long as the requirements for power are at a lower demand. When power demand increases the vacuum switch 41 activates the solenoid or other mechanical device 14 causing valve 9 to open and valves 10, 11, 12 ad 13 to close increasing the vacuum pressure in the engine drawing fuel-air mixture through manifold 7 and increasing the power of the engine to achieve the peak. The exhausts 16 and 17 are also shown as are spark plugs 18, 19,20,21,22,23,24 and 25.

Figure 3:
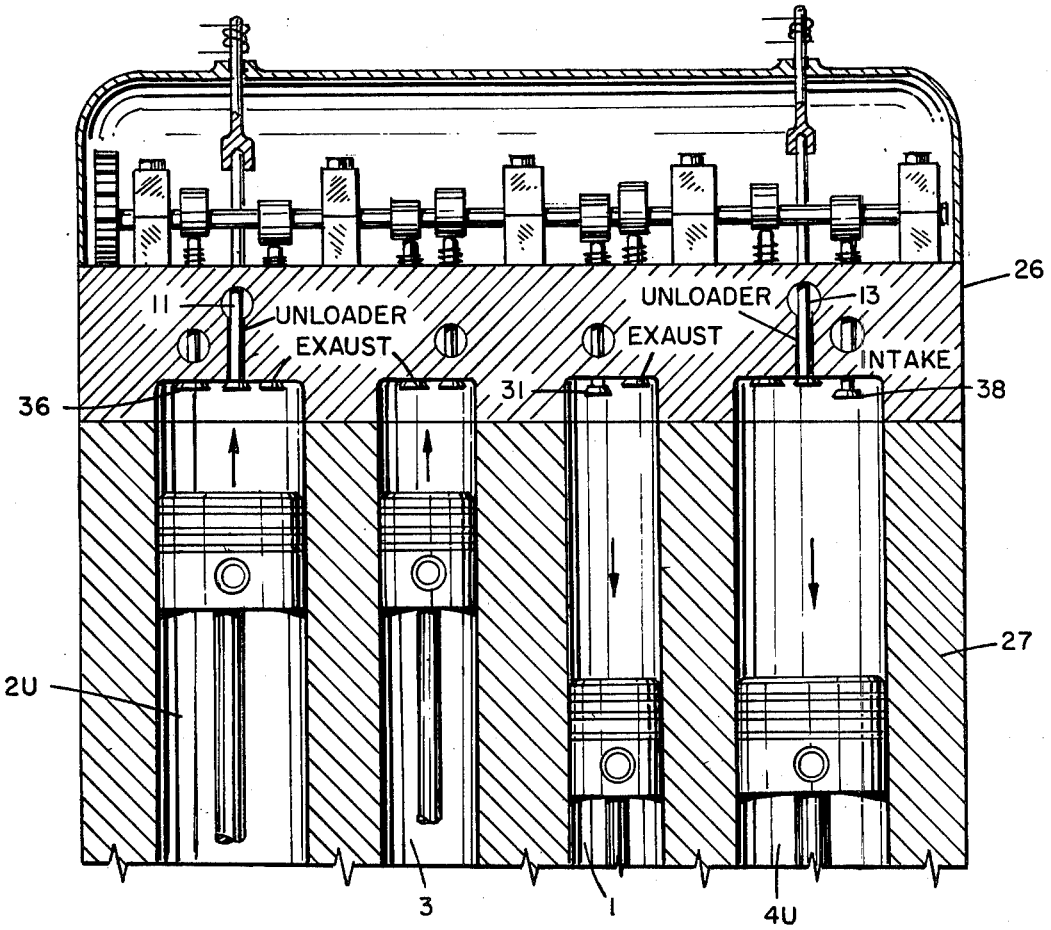
FIG. 3 is a cut through 3—3 of FIGS. 1 and 5 and shows the head of the engine and a part of the cylinders.

In FIG. 3 the one head of the engine 26 is shown. The block 27 is also shown in partial detail as are cylinders 2U, 3, 1 and 4U. In this section the unity of action between cylinders 2U and 3 and 1 and 4U is illustrated. Their direction and action are coupled to achieve balance in the engine and eliminate fuel losses. The other four cylinders are similarly coupled though not shown.

Figure 2:
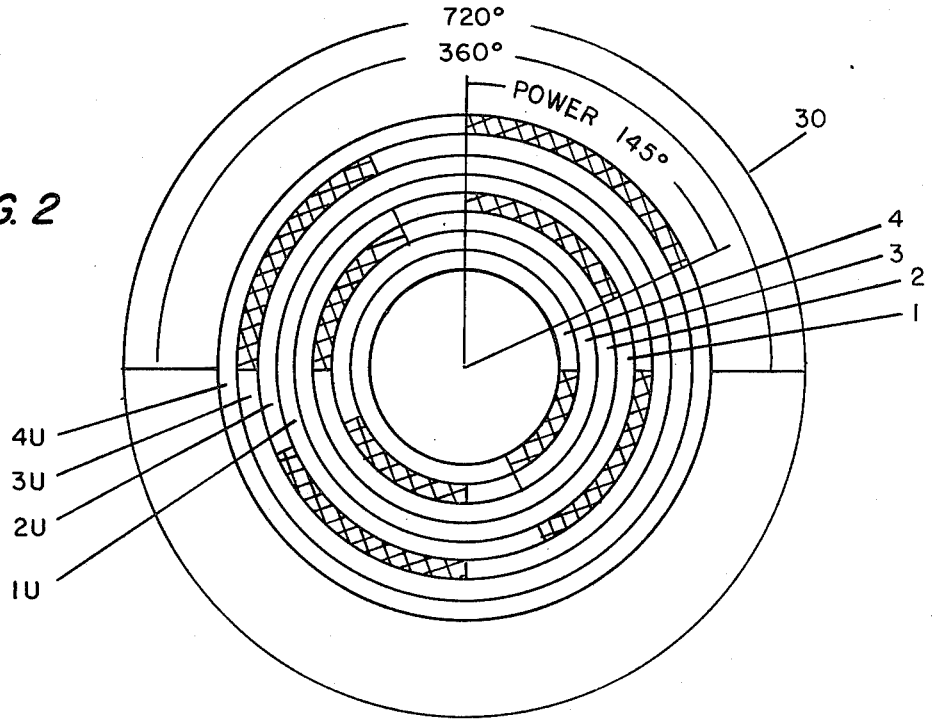
FIG. 2 is a chart of the power sequence of each cylinder showing how an unloading cylinder is mated in action to a loaded cylinder.
Figure 4:
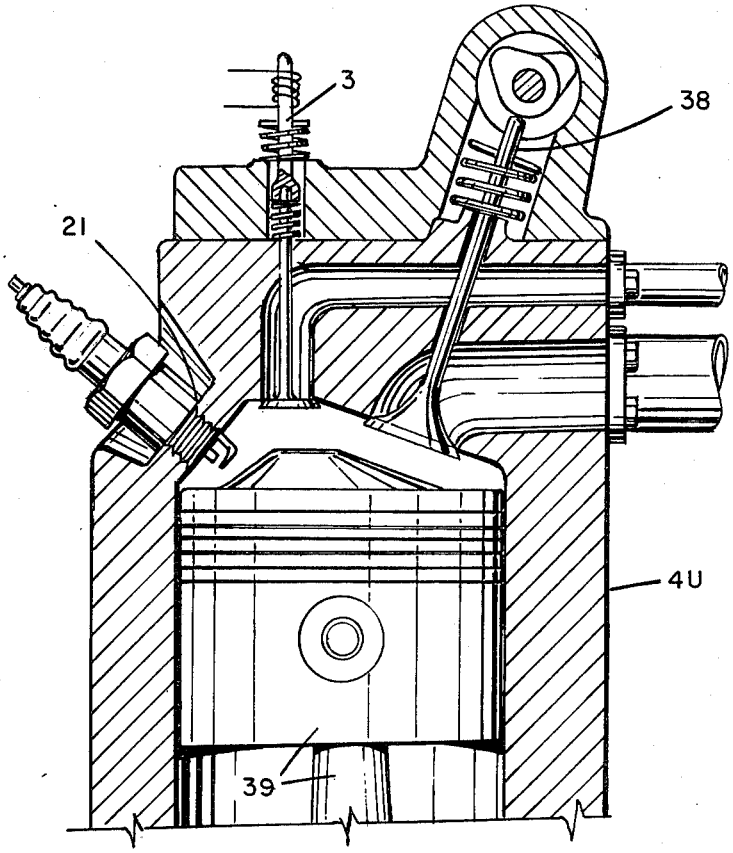
FIG. 4 is a cut through cylinder 4U and shows the arrangement of the spark plug and unloader valve.
Figure 5:
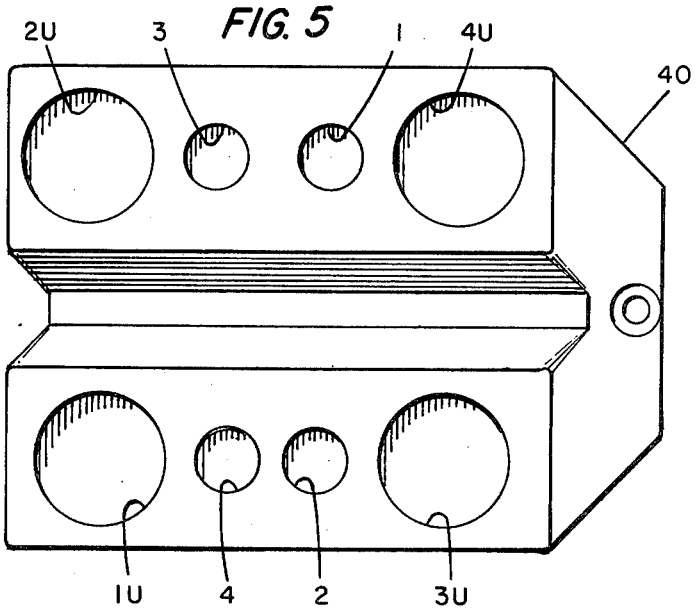
FIG. 5 is a top view of the cylinder block of this invention in a V-8 mode.

FIG. 2 in 30 illustrates the power cycle of the engine. There it can be seen that one continuously operating cylinder 1,2,3, or 4 are coupled with 1U, 2U, 3U and 4U to produce a smooth operating engine. The various gears, pins and rods are all varied to achieve this performance. A single cylinder 4U is also sectioned in FIG. 4. The unloader valve 13 and the spark plug 21 is also sectioned in FIG. 4. The unloader valve 13 and the spark plug 21 are clearly shown as is the intake air fuel mixture valve 38 and piston rod 39 all in the power position. The lower engine block 40 is shown in FIG. 5 with the openings for cylinders 1, 2, 3, and 4 and 1U, 2U, 3U and 4U. The elements making up the exhaust system are all standard and not claimed. The standard mechanisms in the head in FIG. 3 are also not explained or numbered. Thus the apparatus for mileage improvement in an internal combustion engine of this invention is adapted to carry out the objects and attain the ends and advantages mentioned. While certain embodiments of the invention have been described for the purpose of the disclosure, numerous changes in the construction and arrangement of parts can be made by those skilled in the art which changes are encompassed by the appended claims.

I claim:

1. A mileage improvement system for internal combustion engines comprising:

a set of four continually operating cylinders to supply the minimum power requirements plus 10%;

a separate continuous manifold supplying the fuel air system for the four minimum sized cylinders;

four larger unloading cylinders each equipped with an unloading valve and connected to a separate unloading system;

the four larger unloading cylinders when coupled with the appropriate smaller cylinder meet the highest power requirements of the vehicle;

an unloader valve means responsive to the vacuum variations of the minimum cylinder manifold but located in the maximum cylinder manifold and controlling a blade to shut off the maximum cylinder manifold;

a special unloading manifold to divert the contents of the unloading cylinders into opposite unloading cylinders and prevent partially unburned gases and various chemicals from contact with the outside atmosphere;

a set of four unloading valves, each located in one of the four maximum cylinders to release compression or exhaust into a special unloading manifold chamber; and, the maximum and minimum cylinders are coupled in pairs to achieve the maximum power and the minimum unbalance and power surge.

2. A mileage improvement system for internal combustion engines as described in claim 1 in which the unloader valve means is a solenoid.

3. A mileage improvement system for internal combustion engines as described in claim 1 in which the unloader valve means are mechanical devices which achieve the same result as a solenoid.

* * * * *